United States Patent [19]

Bell, Jr.

[11] Patent Number: 4,624,102

[45] Date of Patent: Nov. 25, 1986

[54] METHOD FOR REDUCING BROKEN FIBERS ON THE SURFACE OF A CARBON FIBER YARN BUNDLE

[75] Inventor: John H. Bell, Jr., Charlotte, N.C.

[73] Assignee: E. I. Du Pont de Nemours and Company, Wilmington, Del.

[21] Appl. No.: 747,879

[22] Filed: Jun. 24, 1985

[51] Int. Cl.[4] ..... D02J 3/12; D01H 13/30; D02G 3/40

[52] U.S. Cl. ..... 57/296; 57/210; 57/251; 57/333; 423/447.2; 423/447.8

[58] Field of Search ..... 57/333, 295–298, 57/7, 210, 232, 234, 250, 251; 28/271–276; 264/29.1–29.7; 423/447.1–447.9

[56] References Cited

U.S. PATENT DOCUMENTS

| | | | |
|---|---|---|---|
| 3,009,309 | 11/1961 | Breen et al. | 57/333 X |
| 3,458,987 | 8/1969 | Ozawa et al. | 57/210 |
| 3,490,219 | 1/1970 | Ozawa et al. | 57/333 X |
| 3,783,596 | 1/1974 | Waldkirch | 57/296 |
| 4,207,729 | 6/1980 | Exbrayat et al. | 57/296 |
| 4,351,816 | 9/1982 | Schulz | 423/447.4 |

*Primary Examiner*—John Petrakes

[57] ABSTRACT

A method for reducing broken fibers on the surface of a carbon fiber bundle involves passing the yarn through a passage in a fluid jet which in turn is supplied with a rimming flow of liquid. When the fiber bundle contacts the liquid, some of the broken fibers snap off and others are twisted and unidirectionally cabled back into the fiber bundle.

5 Claims, 3 Drawing Figures

METHOD FOR REDUCING BROKEN FIBERS ON THE SURFACE OF A CARBON FIBER YARN BUNDLE

BACKGROUND OF THE INVENTION

This invention relates to a carbon yarn and more particularly to a method for reducing broken fibers on the surface of the carbon fiber yarn bundle.

Generally, the conventional commercial process for producing a mesophase pitch derived carbon yarn includes the steps of forming a plurality of mesophase pitch fibers to define a mesophase pitch yarn, thermosetting the mesophase pitch yarn to produce a thermoset yarn, and thereafter subjecting the thermoset yarn to a thread-line heat treatment in an inert atmosphere to pyrolyze and carbonize the thermoset yarn and produce the carbon yarn. U.S. Pat. No. 4,351,816 to Schulz describes a known process for producing carbon yarn and recites the problems associated with surface defects such as broken fibers and discloses a method for providing a carbon yarn substantially free of frays or broken fibers.

SUMMARY OF THE INVENTION

The current invention contemplates both breaking off and wrapping broken fibers on the surface of a carbon fiber yarn bundle back into the yarn bundle by the use of a fluid orifice apparatus which provides a rimming flow of liquid within its central or interior passage through a closed passage entering substantially perpendicular to the peripheral surface of the interior passage. The yarn bundle is forwarded through the interior passage at a controlled speed and at a tension sufficient to center the yarn bundle in the interior passage and to overcome any tendencies for the yarn bundle to twist in the jet passage. The yarn bundle is contacted with the rimming flow as the yarn bundle passes through the interior passage. The rimming flow within the jet interior passage acts on the broken fibers on the surface of the yarn bundle to break off some of the fibers as they impact the rimming fluid and to twist and unidirectionally cable others back into the yarn bundle. The yarn bundle is heated to dry it before further processing.

The liquid applicator used in this invention may be of a known type such as an air jet used to exert a torque on a moving threadline to false twist textile yarns. In its simplest embodiment, the fluid jet twister comprises a metal block having a tubular yarn passage which is a smooth, curved, concave surface in combination with one fluid conduit positioned to direct a stream of liquid finish circumferentially about the inner periphery of the curved, concave surface so that the yarn as it passes through the jet is contacted around its periphery by the liquid. Such jets are disclosed in FIGS. 5 and 6 of U.S. Pat. No. 3,009,309.

DETAILED DESCRIPTION OF THE PREFERRED EMBODIMENT

Figure 1:
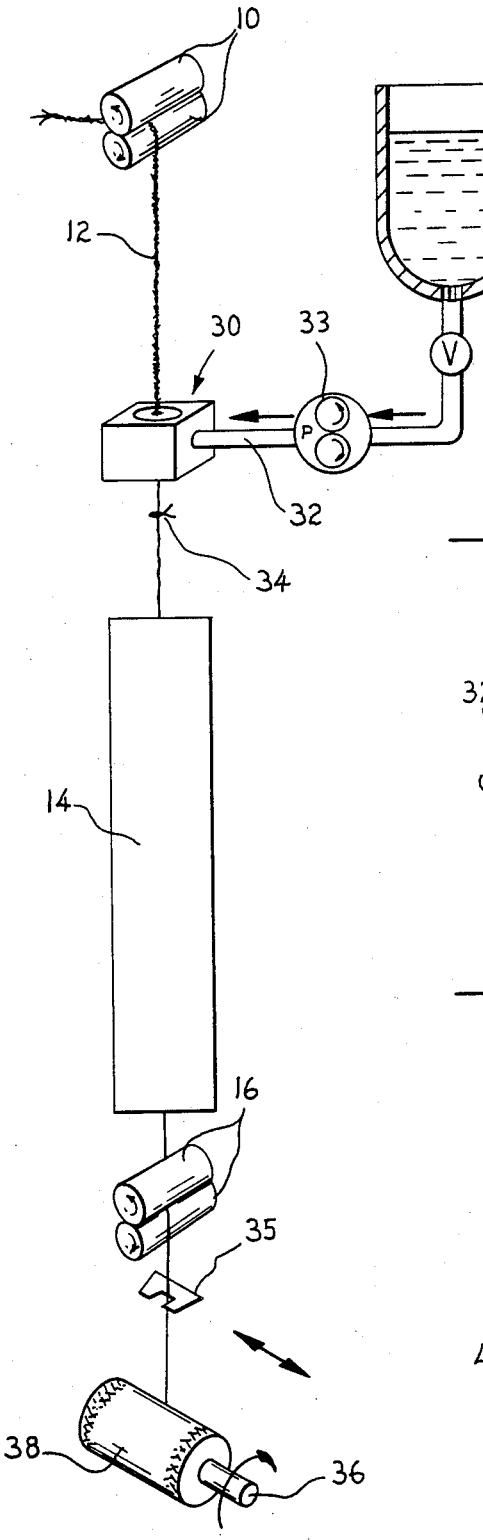
FIG. 1 is a schematic drawing showing use of the subject applicator in a carbon yarn manufacturing operation.

The method chosen for purposes of illustration in FIG. 1 includes a carbon yarn fiber bundle 12 forwarded at a constant speed by rolls 10 from a source (not shown). Carbon yarns of this type are disclosed in U.S. Pat. No. 4,351,816 and include surface defects in the form of broken fibers. Yarn from rolls 10 then passes through liquid applicator 30 into which a metered amount of liquid is pumped through fluid inlet pipe 32 in a continuous stream from source 31 by means of a gear pump 33. The liquid is supplied to applicator 30 at a sufficiently high flow rate to provide a swirling rimming flow within the interior passage of the applicator and the yarn bundle is contacted by the swirling rimming flow which snaps off some and twists other broken fibers and wraps them back into the yarn bundle. The flow rates which provide satisfactory breaking and wrapping of broken fibers generally are those within the range of about 2.5 to about 5 gals per minute. The yarn as it leaves the applicator 30 is directed through a fixed guide 34 into a drying oven 14 after which it encounters another pair of rolls 16 which are driven at a sufficiently higher speed than rolls 10 to provide enough yarn tension to center the yarn axially in the applicator and to overcome any tendencies for the yarn bundle to twist in the applicator. The yarn is then directed through a traversing guide 35 onto a rotating core 36 to form a package 38.

Figure 2:
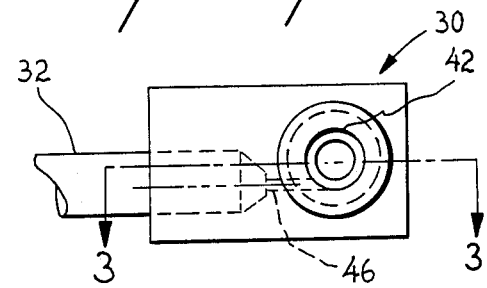
FIG. 2 is a plan view of a preferred liquid applicator of the invention.
Figure 3:
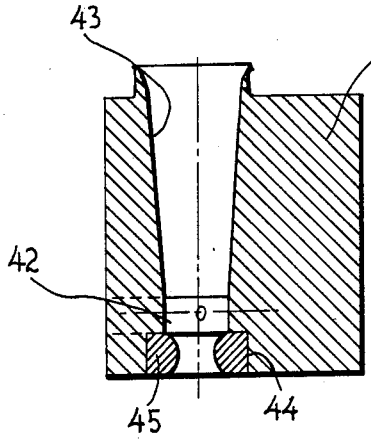
FIG. 3 is an elevation taken along 3—3 of FIG. 2.

The applicator 30 may have a unitary construction as shown in FIGS. 2 and 3 or it may be made of a plurality of parts held rigidly together when in normal operation. The body 40 of the applicator includes a right cylindrical chamber 42 serving as a yarn passage with a frusto conical entrance 43 and a tubular exit 44. A suitable guide 45 is inserted in exit 44. A fluid conduit 46 leading from pipe 32 forms a passage extending through the body and intercepts yarn passage tangentially.

The size of the yarn passage 42 may be selected to suit yarns of varying size. For example an applicator with a passage of 0.250 inch in diameter has been found to be satisfactory for carbon yarns of from about 1000 to about 6000 fibers of about 6 microns each per yarn bundle.

The following example illustrates an embodiment of the invention but is not intended to be limitative.

EXAMPLE

A carbon yarn bundle consisting of 3000 fibers having numerous broken fibers extending from its surface is processed according to FIG. 1 wherein the yarn is passed from driven rolls 10 at four (4) feet per minute into the yarn passage way 42 of a fluid applicator of the type shown in FIGS. 2 and 3 having a cylindrical passage 0.250 inch in diameter and a length of 0.125 inch. A liquid comprising a 1 percent epoxy resin in water is pumped at a rate of 250 cc/minute (about 3¾ gallons per hour) into the fluid conduit 46 of the applicator. Measurements made on the yarn indicated that the tension on the running threadline is 150 grams. From the applicator the yarn passes through dryer 14 to be dried at a temperature of 350° C. for 4 minutes.

Inspection of the treated yarn reveals that it is substantially free of broken fibers extending from the surface of the yarn bundle whereas a control yarn wherein he applicator was either bypassed or the flow of liquid discontinued, showed numerous broken fibers.

When the dilute epoxy solution was replaced with water, above the benefits of the invention are still observable.

I claim:

1. A method for reducing broken fibers on the surface of a carbon fiber yarn bundle comprising: supplying a liquid to a through passage in a jet at a controlled rate of from about 2.5 to about 5 gallons per minute in a path substantially tangential and perpendicular to said passage to provide a rimming flow within the passage; forwarding the carbon yarn bundle through said passage at a controlled speed and tension sufficient to center the carbon yarn bundle with the passage and to overcome any tendencies for the yarn bundle to twist in the jet passage; contacting the yarn bundle with said rimming flow of liquid as it passes through the jet passage to snap off some of said broken fibers and to wrap others back into said yarn bundle; and heating said yarn bundle to dry it.

2. The method of claim 1, said liquid being a finish solution of about 1% epoxy resin in water, said heating step also cures the resin on said yarn bundle.

3. The method of claim 1 said controlled rate being about three gallons per minute, said tension being about 150 grams, said speed being about four feet per minute.

4. The method of claim 1, said heating step being at about 350° C. for about four minutes.

5. The method of claim 1, said liquid being water.

* * * * *